US005267777A

United States Patent [19]

Valtri

[11] Patent Number: 5,267,777

[45] Date of Patent: Dec. 7, 1993

[54] RESILIENT CHAIR SUPPORT

[75] Inventor: Frank J. Valtri, Warminster, Pa.

[73] Assignee: Lavaco Industries, Inc., Ivyland, Pa.

[21] Appl. No.: 821,399

[22] Filed: Jan. 15, 1992

[51] Int. Cl.[5] ..... A47C 3/00

[52] U.S. Cl. ..... 297/302; 297/301

[58] Field of Search ..... 297/301, 302, 303, 304, 297/198

[56] References Cited

U.S. PATENT DOCUMENTS

| | | | |
|---|---|---|---|
| 448,739 | 3/1891 | Edwards . | |
| 468,998 | 2/1892 | McGlinchey . | |
| 477,277 | 6/1892 | Smith . | |
| 525,190 | 8/1894 | Devore . | |
| 533,921 | 2/1895 | Richmond . | |
| 583,433 | 5/1897 | Hall . | |
| 591,573 | 10/1897 | Seaman . | |
| 640,373 | 1/1900 | Fleming . | |
| 2,931,423 | 4/1960 | Kalter . | |
| 3,290,091 | 12/1966 | Goodman . | |
| 3,369,840 | 2/1968 | Dufton | 297/303 |
| 3,682,509 | 8/1972 | Worley . | |
| 3,740,792 | 6/1973 | Werner . | |
| 4,500,137 | 2/1985 | Morehouse . | |
| 4,575,150 | 3/1986 | Smith . | |
| 4,695,093 | 9/1987 | Suhr et al. . | |
| 4,832,402 | 5/1989 | Zünd . | |
| 4,871,208 | 10/1989 | Hodgdon . | |
| 4,889,384 | 12/1989 | Sulzer . | |
| 4,889,385 | 12/1989 | Chadwick et al. | 297/301 X |
| 5,080,318 | 1/1992 | Takamatsu et al. | 297/302 X |

FOREIGN PATENT DOCUMENTS

| | | | |
|---|---|---|---|
| 3800751 | 8/1988 | Fed. Rep. of Germany | 297/302 |

*Primary Examiner*—Laurie K. Cranmer

*Attorney, Agent, or Firm*—Reed Smith Shaw & McClay

[57] ABSTRACT

An ergonomic chair supported by a cantilever support arm is resiliently coupled to the support arm by a resilient transverse support bar providing laterally spaced points of support for the chair, and by a resilient longitudinally extending support bar, providing a longitudinally aligned point of support. The support bars allow for limited and controlled yielding of the seat members in fore and aft, side-to-side, and oblique directions, to encourage subtle muscular action of the user. Provision is made for adjustment of the stiffness of the latter support bar, and for fore and aft angular adjustment of the seat.

23 Claims, 6 Drawing Sheets

RESILIENT CHAIR SUPPORT

BACKGROUND OF THE INVENTION

This invention relates to a chair and its support, and more particularly, to a chair and support designed to provide in use a degree of controlled "yield" for the particular purposes described below.

Studies in the field of ergonomics have shown that by encouraging subtle and unconscious use of muscle groups ordinarily at rest, the body may be energized in a way which manifests itself in longer, more comfortable and more efficient work spans. In one of its aspects, the present invention provides a resilient seat support, exploiting elastomeric and other spring elements as well as the flexibility and resilience of other parts of the chair, to provide a controlled yield in the fore and aft, as well as lateral and oblique directions. In other words, when the occupant of a chair in accordance with the invention chooses to lean to the rear, a tilting action, conventional in many chairs, takes place. If the occupant also leans slightly to the left or to the right, or if the occupant while sitting upright reaches to the left or right, the chair shifts slightly to a limited and desirable extent, following the body and inducing the occupant to use a series of different muscle groups to counteract the tilt.

It has been suggested that these desired body movements be facilitated by the design of a chair. See, for example, U.S. Pat. No. 4,500,137, issued Feb. 19, 1985, to Laurence E. Morehouse. The chair shown in that patent, by its shape, seeks to motivate and accommodate motion by the occupant. The present invention likewise seeks to accommodate beneficial motion, but uses a different approach.

SUMMARY OF THE INVENTION

With the above in mind, the present invention provides, in general, a chair, preferably with a unitary seat element having a seat base and a seat back, a support pedestal provided with casters and a pneumatic or hydraulic support cylinder, and a cantilever support arm extending between the pedestal and the seat element to support the seat element. An ergonomic seat support is provided between the cantilever arm and the seat element, and accommodates and facilitates controlled movement between them. In one presently preferred form of the invention, the support arm engages and supports a bracket member, disposed transversely beneath a forward portion of the seat base, and the bracket member receives and supports in turn a transversely disposed support bar. The support bar is resiliently coupled to the bracket member and secured to the seat element at laterally spaced points.

Extending longitudinally and rearwardly from the bracket is, in essence, a second support bar in the form of a cantilever leaf spring member, whose distal (free) end slidably engages the bottom of the seat base at a rearward location. The three-point support provided by the distal end of the cantilever spring member and the respective ends of the support bar provide a support plane for the seat element, but the resilience of the leaf spring and the mounting of the support bar allow for a fore and aft hinging action about the transverse axis provided by the support bar. Similarly, although to a lesser extent, the elastomeric elements and the support bar allow for side-to-side yielding of the seat element in response to leaning or reaching of the user/occupant of the seat. The resilient coupling between the support bar and the bracket also acts as a shock absorber when a user first sits in the chair.

The seat element may itself provide limited incidental yieldability and flexibility during tilting action, fore and aft or side-to-side, and such yielding adds to the desirable stimulus of subtle body movements.

In the above-described form of the invention, the cantilever spring is a five leaf slipper spring, whose mounting in association with the above-mentioned bracket places the fulcrum point of seat element movement far forward relative to the center of gravity of the combined occupant and chair element, farther forward than in conventional "knee-tilting" chairs such as those shown in U.S. Pat. No. 4,832,402, issued May 23, 1989, to Zund and U.S. Pat. No. 4,889,384, issued Dec. 26, 1989, to Sulzer. The longer flexure arm thus provided yields a smooth movement ("ride") and also allows for left or right lean, even at the end of the fore and aft tilting range, thereby enhancing the opportunity for desirable muscle group stimulation and action.

In another presently preferred form of the invention, the transversely disposed support bar may itself be made as a leaf spring member. In such an arrangement, the support arm supports respective anchor, or proximal, portions, of both the first-mentioned cantilever leaf spring member (extending longitudinally and rearwardly with respect to the seat element) and the transversely disposed leaf spring member.

As an added feature of the present invention, provision may be made for angular adjustment, for comfort or convenience, of the initial fore and aft tilt position of the seat element of the chair (and hence, of the chair), relative to the support bar and hence the floor on which the chair is disposed.

BRIEF DESCRIPTION OF THE DRAWINGS

There are seen in the drawings forms of the invention which are presently preferred (and which represent the best mode contemplated for carrying the invention into effect) but it should be understood that the invention is not limited to the precise arrangements and instrumentalities shown.

DESCRIPTION OF THE PREFERRED EMBODIMENT

Figure 1:
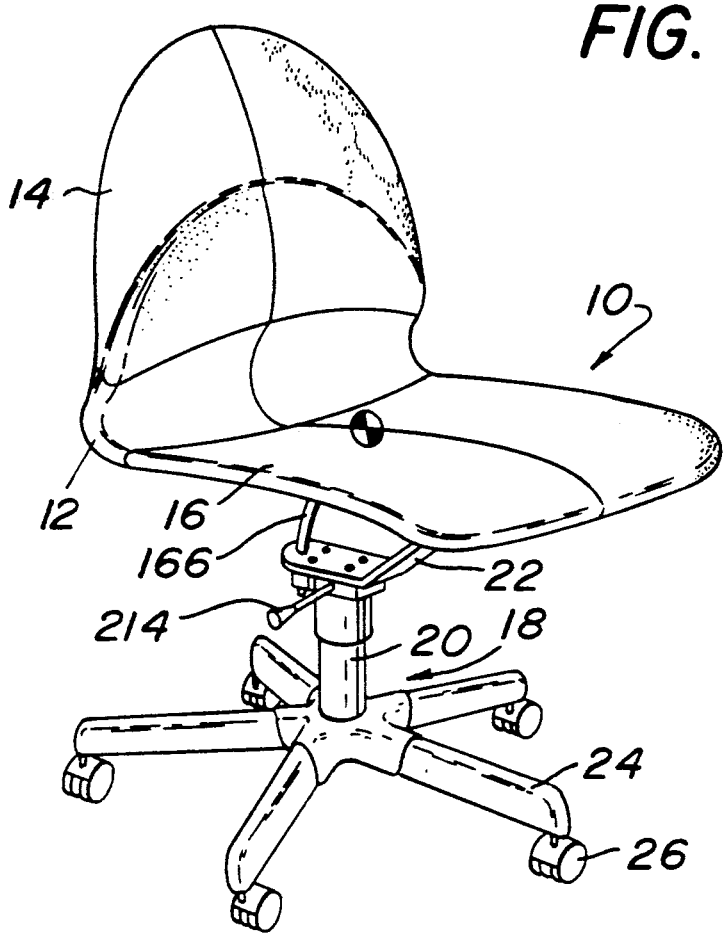
FIG. 1 is a perspective view of a chair which embodies the invention.

Referring now to the drawings in detail, wherein like elements are indicated by like reference numerals, there is seen in FIG. 1 a chair designated generally by the reference numeral 10.

The chair 10 includes a seat element, or shell, 12, consisting of a seat back 14 and seat base 16. In the illustrated form of the invention, the seat element 12 is a unitary shell structure, preferably made of "Pagwood", a strong, relatively resilient, pressure molded wood-plastic composite. Other composite materials and conventional seat-forming materials, such as plywood or formed metal, may also be used. The seat element 12 may be covered with fabric, padded or upholstered as desired.

The seat element 12 is supported by a base, designated generally by the reference numeral 18, a pedestal 20 and a cantilever support arm 22. The pedestal 20, as can be seen in FIG. 1, extends upwardly from a central portion of the base 18, and the support arm 22 is affixed or coupled to an upper portion of the pedestal 20.

Although the design of the illustrated base 18 should be considered exemplary, such bases typically include plural radially disposed arms 24, supported by casters or other rolling supports 26.

Typically, the pedestal 20 contains a gas cylinder (not seen) which provides for cushioning and for selective height adjustment (typically in a range of four inches of the seat) element 12. The pedestal 20, support arm 22 and seat base 16 typically provide an overall height to the top of the seat base 16 of sixteen and one half inches.

Figure 2:
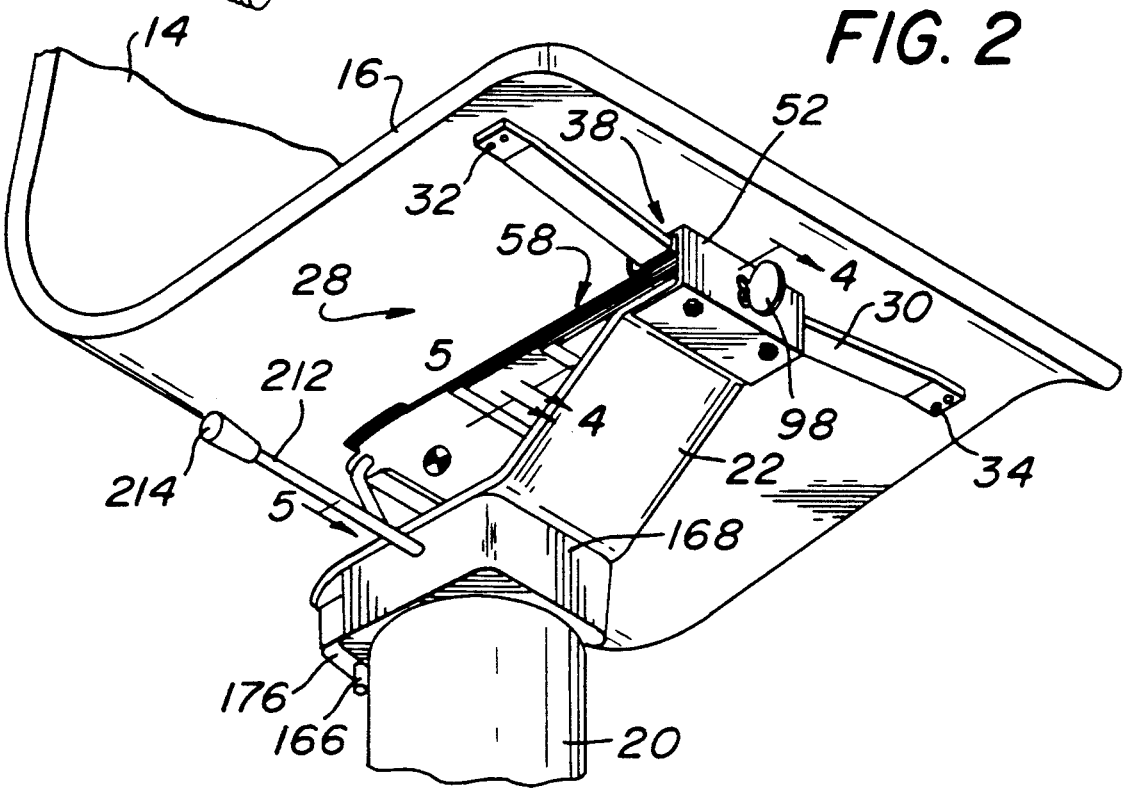
FIG. 2 is a partial perspective view, showing an embodiment of a chair support in accordance with the invention.

Referring now to FIG. 2, there is seen a seat support designated generally by the reference numeral 28. The seat support 28 comprises a support bar 30, extending laterally with respect to the seat base 16. Respective ends of the support bar 30 extend outwardly toward the sides of the seat base 16, and are secured to the seat base by suitable fasteners 32 and 34 at laterally spaced locations on the seat base 16.

Figure 3:
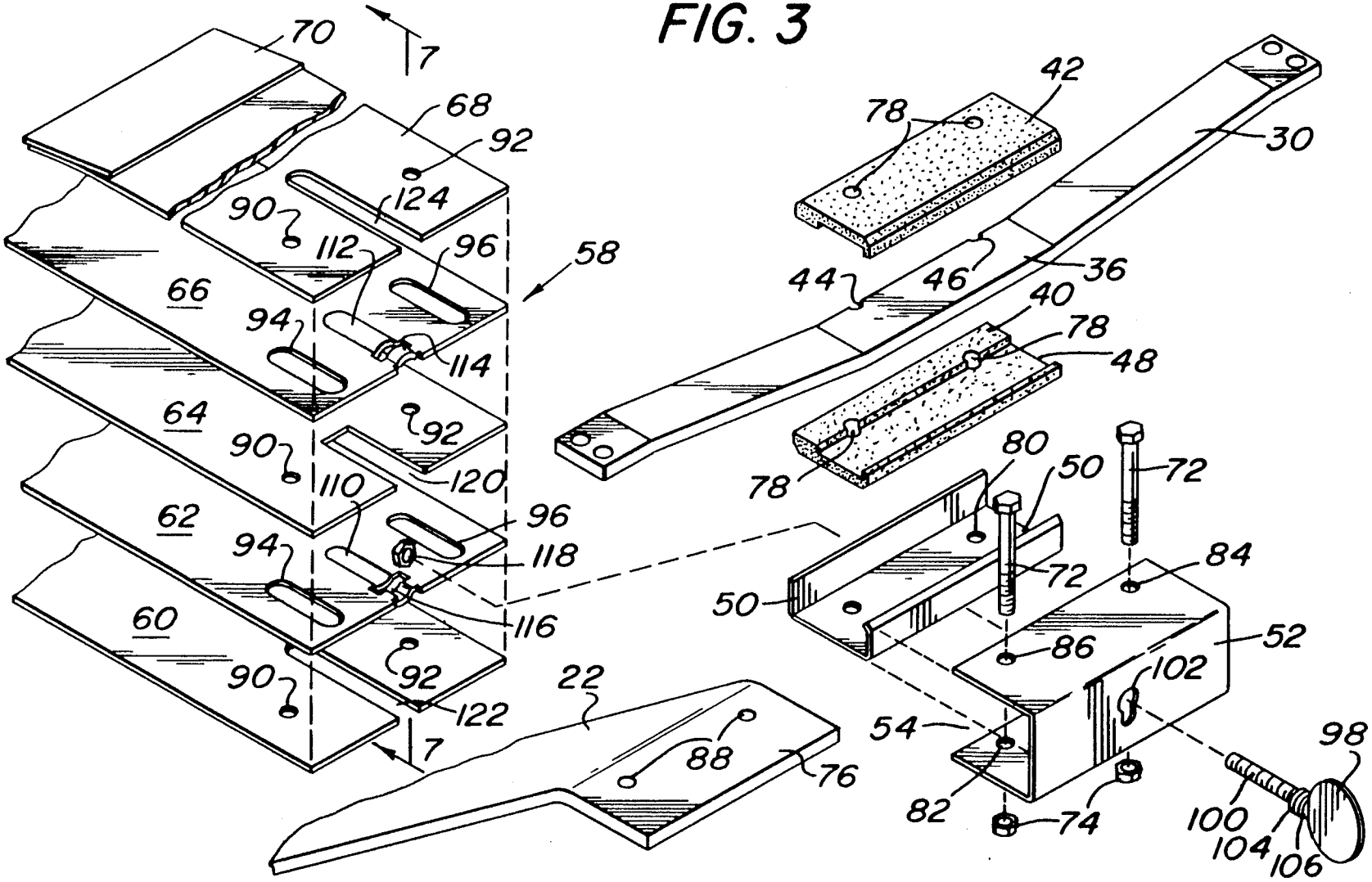
FIG. 3 is an exploded view, showing in perspective details of a chair support of the kind shown in FIG. 2.
Figure 4:
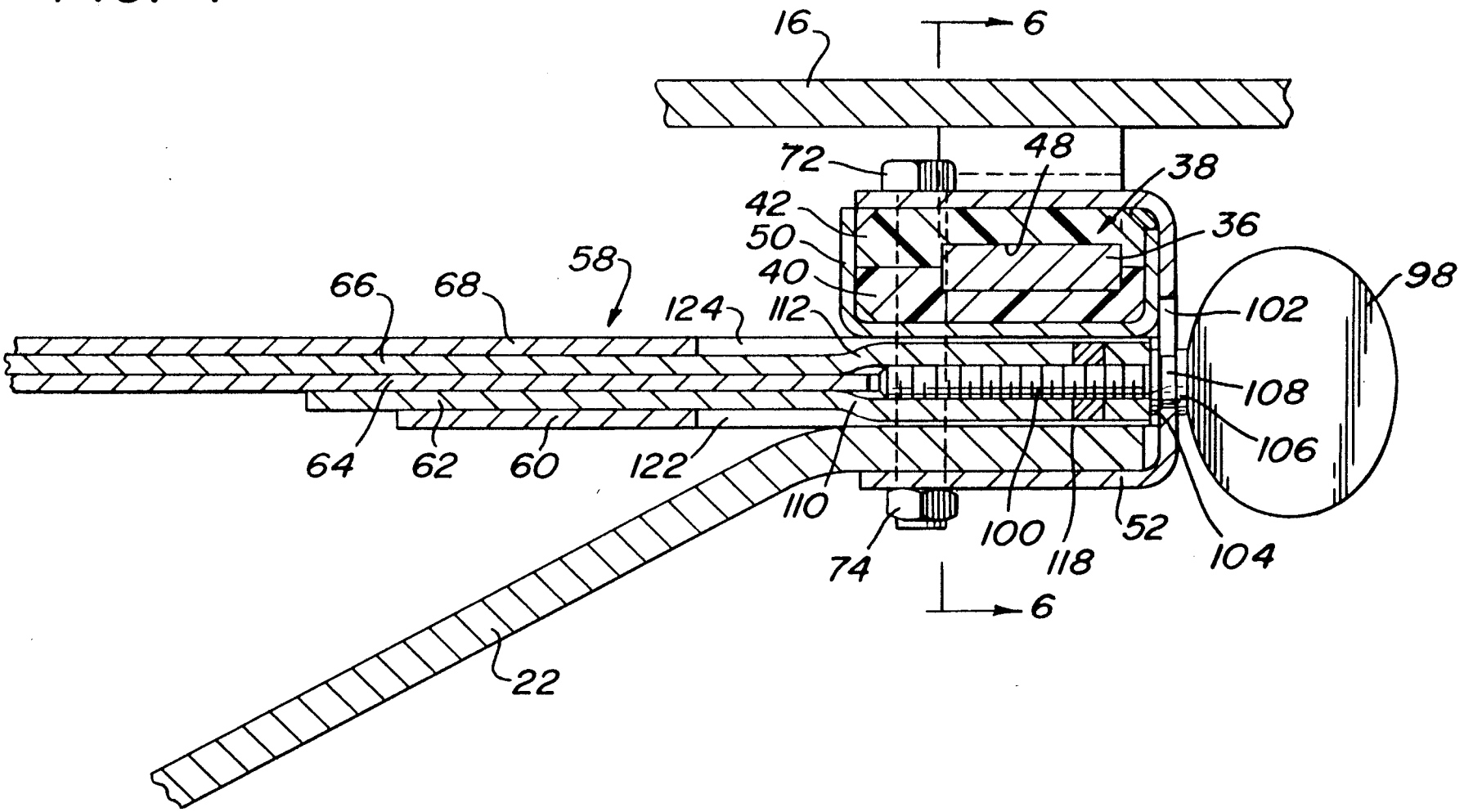
FIG. 4 a partial cross-sectional view, taken along the line 4—4 in FIG. 2.
Figure 6:
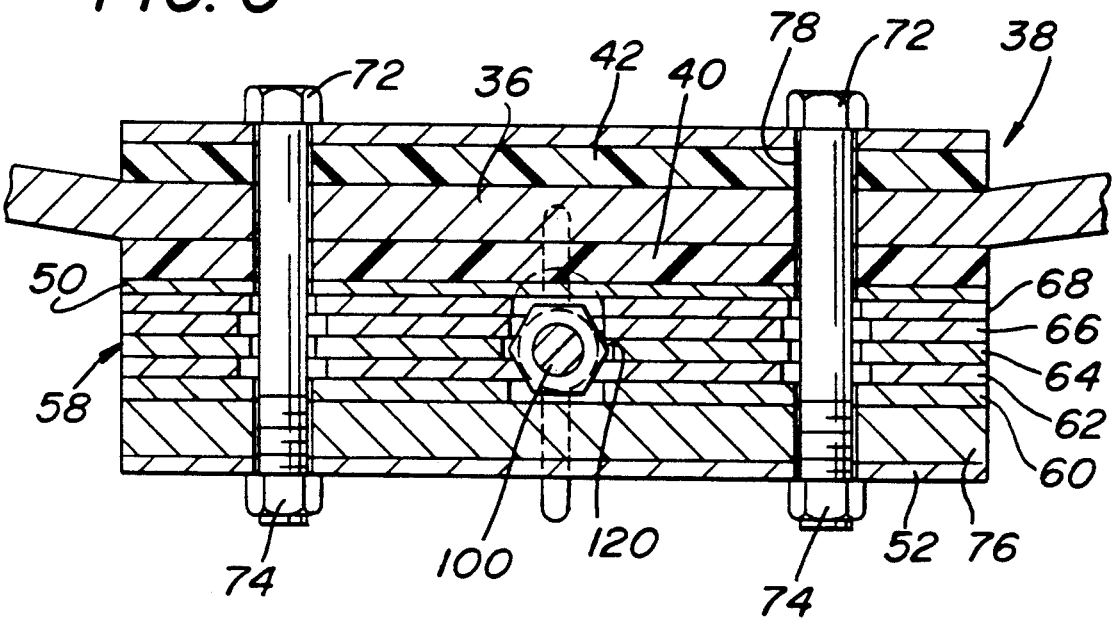
FIG. 6 is a cross-sectional view taken along the line 6—6 in FIG. 4.

As is perhaps best seen in FIGS. 3, 4 and 6, a central portion 36 of the support bar 30 is encapsulated by a resilient elastomeric cushion member designated generally by the reference numeral 38, made up in the illustrated embodiment of respective lower and upper halves 40 and 42. The central portion 36 of the support bar 30 is provided with spaced notches 44 and 46 (seen in FIG. 3), the purpose of which will shortly be made apparent. The cushion member 30 may be made of rubber (preferably of about 95 Durometer hardness) or other equivalent and suitable materials.

The lower and upper halves 40, 42 of the elastomeric cushion member 38 preferably have identical, mirror image, configurations, and are grooved, as at 48, to receive the central portion 36 of the support bar 30.

The halves 40 and 42 of the cushion member 38, encapsulating the central portion 36 of the support bar 30, are mounted in a retainer channel 50, which in turn is received within a bracket member 52. Referring to FIGS. 2, 3 and 4, it will be seen that the bracket member 52 is coupled to and supported by the support arm 22. As is perhaps best seen in FIG. 3, the bracket member 52 provides a channel, an open mouth portion 54 of a which is of a width sufficient to receive the retainer channel 50 and its associated elastomeric member 38, a distal end 56 of the support arm 22 and a cantilever support bar 58 which will now be described in detail.

Figure 5:
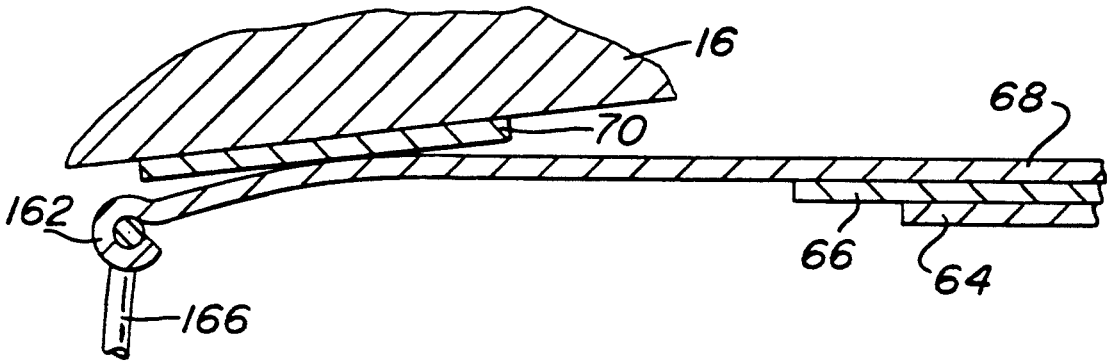
FIG. 5 is a partial cross-sectional view taken along the line 5—5 in FIG. 2.

The cantilever support bar 58 comprises, in the illustrated form of the invention, a leaf spring of five leaves, designated by the reference numerals 60, 62, 64, 66 and 68. In operation, the uppermost leaf, 68 contacts (as is best seen in FIG. 5), a rub strip 70 associated with the bottom wall of the seat base 16.

The stiffness of the leaf spring defining the cantilever support bar 58 is variable, in a manner described below.

Referring now to FIGS. 3 and 6, it will be seen that in the illustrated embodiment the support bar 30 and cantilever support bar 58 are retained in the bracket member 52 by bolts 72 and 74, which, in turn, secure the bracket member 52 to the distal end 76 of the cantilever support arm 22. The lower and upper halves 40, 42 of the elastomeric member 38 are provided with openings 78 and the retainer channel 50 is provided with openings 80 and 82, all in alignment with openings 84 and 86 in the bracket 52. The bolts 72 and 74 pass through the above described openings, and also through openings 88 in the distal end of the support arm 22. The notches 44 and 46 in the support bar 30 serve as clearance openings for the bolts 72 and 74, and facilitate movement of the support bar 30 within the limits defined by the resilience of the elastomeric member 38. The notches do provide, however, an important stabilizing feature and prevent excessive deformation of the elastomeric member 38 or canting of the support bar 30 relative to the bracket member 52.

The manner in which the stiffness of the leaf spring defined by the cantilever support bar 58 is made adjustable will now be described. Provision is made in the preferred embodiment for selective sliding of two of the leaves 62 and 66 relative to the others. Thus, the area of greatest thickness of the spring (and thus the greatest resistance to bending), can be shifted selectively to achieve the desired effect. The features which facilitate this adjustability are best seen in FIGS. 3, 4, 6 and 7, and will now be described in detail.

Referring now to FIG. 3, it will be seen that the leaves 60, 64 and 68, which are not movable for adjustment purposes, are provided with openings, of which the openings 90 and 92 in the leaf 68 may be taken as typical. These openings are spaced to be aligned when the parts are assembled, with the openings 78 in the elastomeric member 38, the openings 80 in the retainer channel 50, the openings 82 in the bracket member 52, and the openings 88 in the distal end 76 of the support arm 22. Thus, referring now to FIG. 6, the entire assembly may be "sandwiched" and anchored within the bracket 52, with the leaves 60, 64 and 68 of the leaf spring held in position by the bolts 72 associated with nuts 74.

Referring again to FIG. 3, the movable leaves 62 and 66 are provided, in alignment with the openings 90 and 92, with elongated slots, of which the slots 94 and 96 of the leaf 66 are typical. The slots 94 and 96 enable the leaves 62 and 66 to slide relative to the bolts 72 within the limits of the lengthwise dimensions of the slots.

Sliding of the leaves 62 and 66 is actuated by a key 98, threaded at 100, rotatably mounted in a keyhole slot 102 in the bracket 52. The key 98 is provided on its threaded shank 100 with a pair of spaced cylindrical ridges 104 and 106, defining between them a cylindrical land or boss 108. The diameters of the ridges 104 and 106 correspond to the larger diameter of the keyhole slot 102. The diameter of the land or boss 108 is complemental with that of the narrower portion of the keyhole slot 102. Thus, for the purpose of assembly, the key 98 may be placed within the keyhole slot 102 and shifted so that its land or boss 108 rides within the narrower portion of the keyhole slot. Thus positioned, the key 100 may be rotated relative to the bracket 52, and maintained in position by the ridges 104 and 106 operating within the confines of the narrower portion of the keyhole slot 102.

Figure 7:
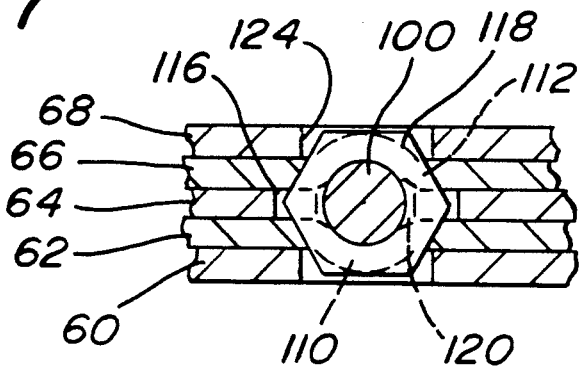
FIG. 7 is a detailed view, in cross-section, showing an aspect of a spring adjusting mechanism in accordance with the invention.

Referring again to FIG. 3 and also to FIG. 7, the movable leaves 62 and 66 are provided with either offset portions 110 and 112, as shown, or open slots (not shown), and with transverse slots 114 and 116. The slots 114 and 116 are adapted, in the illustrated embodiment, to receive, and abut and capture a nut 118 threadedly engaged with the shank 100 of the key 98. Translational movement of the nut 118 relative to the shank 100 causes translation of the movable leaves 62 and 66 to a like extent. Although other means may occur to those skilled in the art, movement of the nut 118 relative to the threaded shank 100 of the key 98 is secured in the illustrated embodiment by constraining the nut from rotation relative to the leaves 60–68 of the leaf spring but allowing it to translate relative to the shank 100 upon selective rotation of the key 98.

To accommodate the threaded shank 100 of the key 98 and constrain the nut as mentioned above, but allow for translational movement of the nut 118, the leaf 64 is provided with a clearance slot 120 of a width sufficient to receive the nut 118. Also, the leaves 60 and 68 are provided with clearance slots 122 and 124, respectively, which accommodate the offset portions 110 and 112 of the leaves 62 and 66, respectively, as well as the nut 118.

The relationship of the nut 118 to the various leaves 60–68, the offset portions 110 and 112, and the clearance slots 120 and 122 is perhaps best seen in FIG. 7, and seen in part in FIGS. 4 and 6 as well.

It should now be apparent that rotation of the key 98 will cause the nut 118 to translate relative to the threaded shank 122 of the key 100. In so translating, the nut 118, bearing on the edges of the transverse slots 114 and 116, causes the leaves 62 and 66 to move in the same sense as the nut 118. Movement to the left in FIGS. 3 and 4 in effect lengthens the leaves 62 and 66, stiffening the support bar 58. Movement to the right in effect shortens the leaves and reduces the stiffness of the support bar 58.

Those skilled in the art will appreciate that other specific mechanisms may be used to vary the stiffness of the support bar 58.

Figure 8:
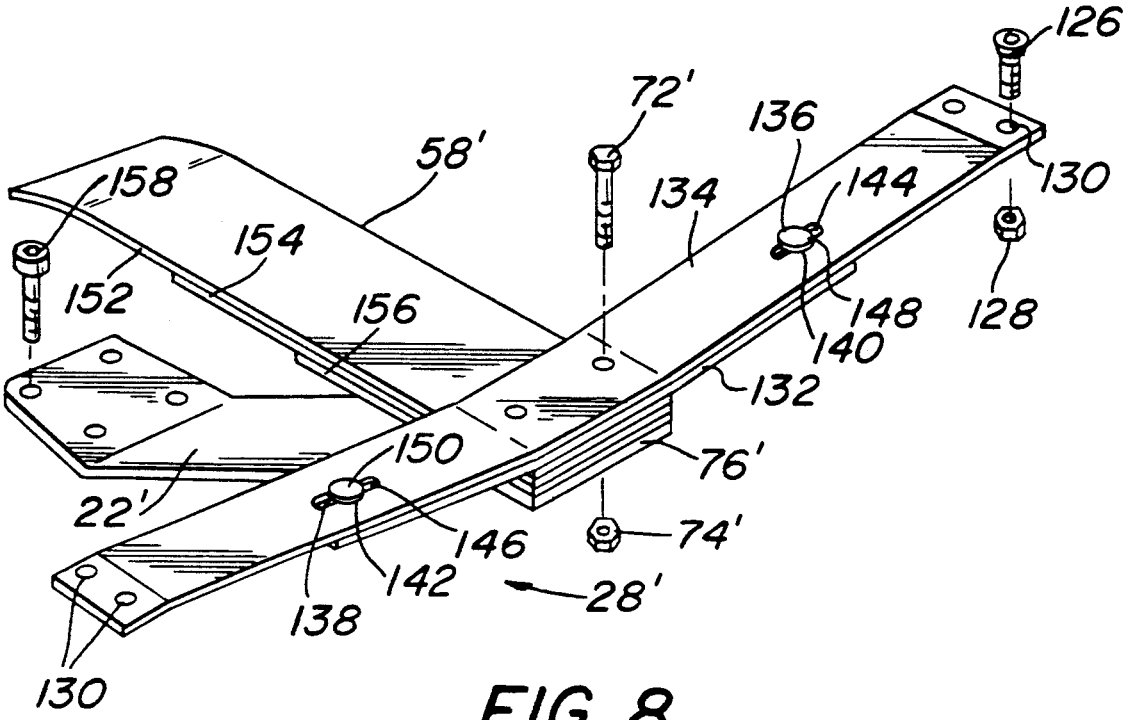
FIG. 8 is a partial perspective view, showing another embodiment of a chair support in accordance with the invention.

Referring now to FIG. 8, there is seen in detail another, somewhat simplified, form of the invention, in which elements corresponding to those previously described are designated by like, primed (′), reference numerals. The seat support 28′ of FIG. 8 provides a support bar 30′, arranged to extend laterally with respect to the seat base (not shown) with which the seat support 28′ is associated. Thus, respective ends of 15 the lateral support bar 30′ extend outwardly toward the sides of an associated seat base, and may be secured thereto by suitable fasteners, such as the illustrated bolts 126 and nuts 128, associated with suitable openings 130 in the lateral support bar 30′.

The lateral support bar 30′ in the embodiment shown in FIG. 8, comprises a cantilever leaf spring of two leaves, a lower leaf 132 and an upper leaf 134. The leaves 132 and 134 may advantageously be tied together, as by the sliding pin connections 136 and 138 or other suitable means. The sliding pin connections 136 and 138 consist of respective rivets 140 and 142, secured to the leaves 132 and 134, and associated with elongated Outwardly directed slots 144 and 146 in the leaves 132 and 134. Flexing of the leaves 132 and 142 results in the rivets 140 and 142 moving within the slots 144 and 146, while heads 148 and 150 of the rivets maintain the leaves 132 and 134 in juxtaposition to each other regardless of the direction of flexing of the leaves 132 and 134. Such an arrangement keeps the bottom leaf 132 mechanically active in all conditions of flex, whether the seat base is displaced left, right or obliquely. The slots 144 and 146 also provide, in effect, limit stops for lateral (side-to-side) movement of the seat element.

The longitudinally extending cantilever support bar 58′ in the embodiment shown in FIG. 8 comprises a leaf spring of three leaves, designated by the reference numerals 152, 154 and 156. The uppermost leaf 152, it will be understood, preferably contacts a rub strip like the rub strip 70 (not shown in FIG. 8) associated with a seat base (likewise not shown).

Both the lateral support bar 30′ and the longitudinally extending cantilever support bar 58′ are secured to the cantilever support arm 22′, which may in turn be coupled or secured, as by the illustrated machine screws 158, to a pedestal, not shown, like the pedestal 20. In the simplified form depicted in FIG. 8, both the lateral support bar 30′ and the longitudinally extending cantilever support bar 58′ are secured to the distal end 76′ of the cantilever support arm 22′ by bolts, such as the bolt 72′. Bolts 72′ and associated nuts, such as the nut 74′, serve to clampingly secure both support bars to the cantilever support arm 22′.

Figure 9:
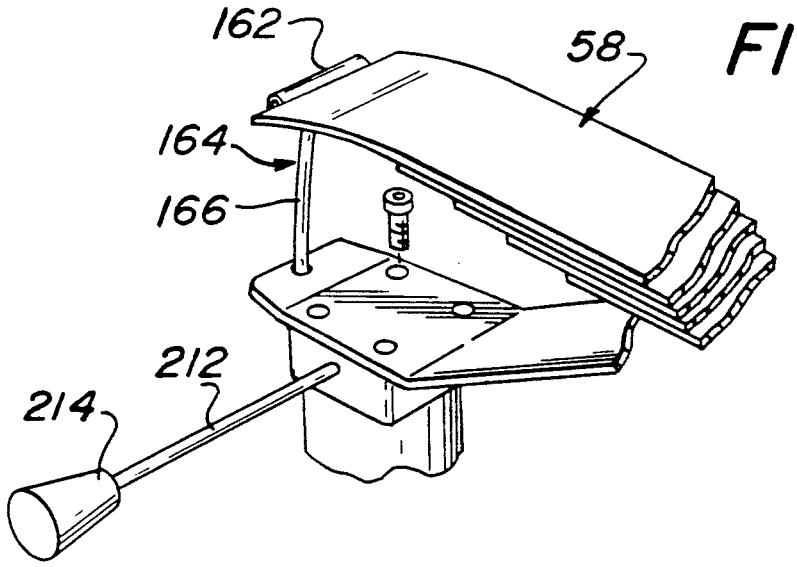
FIG. 9 is a view, in perspective of a detail of the present invention.
Figure 10:
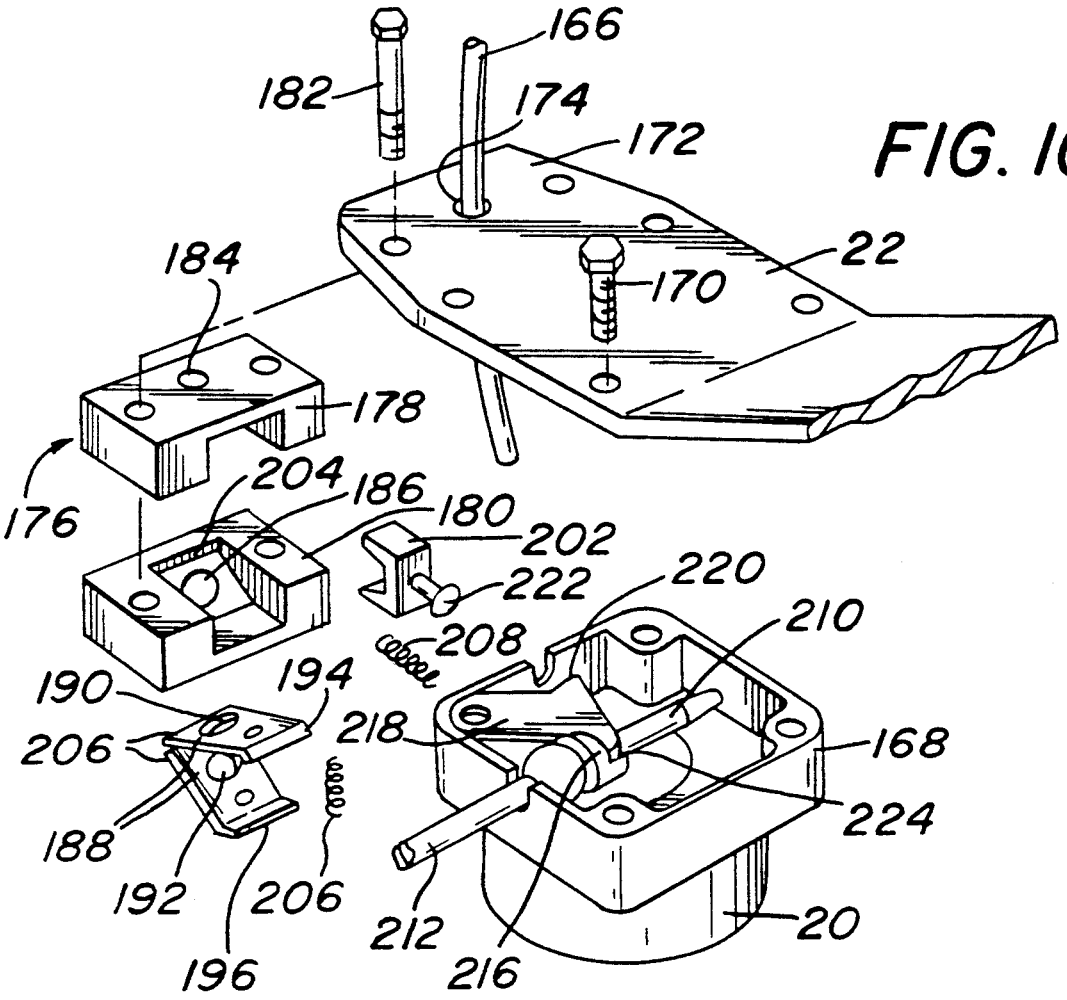
FIG. 10 is an exploded view of a mechanism facilitating the setting and angular adjustment of the fore and aft tilt position of a chair in accordance with the invention.
Figure 11:
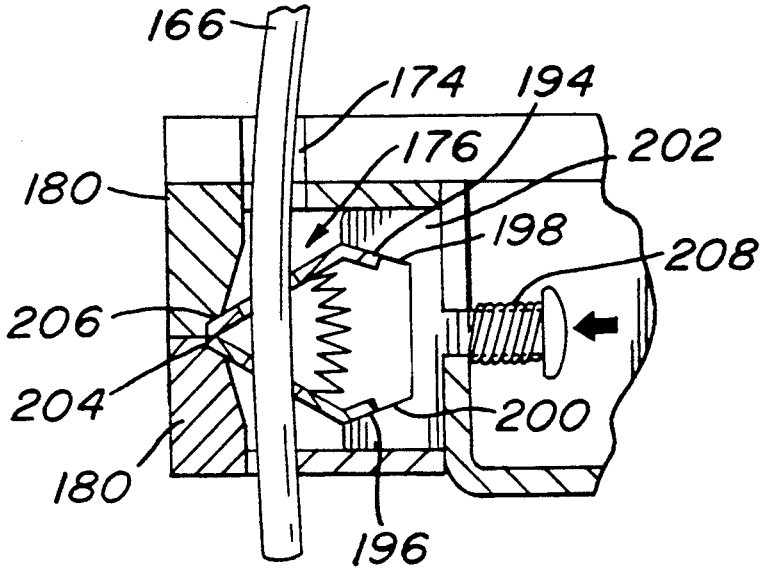
FIG. 11 is a partial cross-sectional view, showing details of the mechanism shown in FIG. 10.

Referring now to FIGS. 9 to 11, there is seen in association with the seat support 28 a mechanism which can, if so desired, serve selectively to control the initial tilt, fore and aft (that is, about an axis extending transversely with respect to the seat base), of the chair 10.

Referring now to FIG. 9, there is seen in perspective the rear portion of the cantilever support bar 58, with its constituent leaves 60–68. In the illustrated form of the invention, the uppermost leaf 68 has at its rearmost edge 160 a cylindrical boss 162 (seen also in FIG. 5), which may advantageously be formed as an extension of the leaf 68. Pivotably received in the boss 162 is a locking bar 164, which has an arcuate hasp member 166 extending generally downwardly from the boss 162.

Referring now to FIGS. 10 and 11, the mechanism for securing the hasp member 166 to adjust the tilt of the seat 10 will now be described. Disposed in the illustrated form of the invention between the pedestal 20 and cantilever support arm 22 is a box-like housing 168. The housing 168 may be formed intregally with the pedestal, or may be secured to it in any suitable manner. Bolts, such as the exemplary bolt 170, may secure the cantilever support arm 22 to the housing 168.

Within and associated with the housing 168 is a mechanism for selectively engaging and locking relative to the cantilever support arm 22 and housing 168 the hasp member 166. The cantilever support arm 22 is provided with an extended portion 172, provided with an opening 174 through which the hasp member 166 passes. Secured to the underside of the extended portion 172 is a locking chamber 176, made up of respective upper and lower halves 178 and 180. The locking chamber 176 is secured to the extended portion 172 of the cantilever support arm 22 by bolts, such as the illustrated bolt 182, or other suitable means. The respective upper and lower halves 178 and 180 of the locking chamber 176 are provided with bores 184 and 186, which, when the apparatus is assembled, are aligned generally with the opening 174. Referring to FIG. 11, it will be seen that when the parts are assembled, the hasp member 166, which is arcuate in shape, passes through the openings 174 and bores 184 and 186.

Disposed within the locking chamber 176 is a pair of locking plates 188, each provided with an opening 190, 192, through which the hasp member 166 passes. The locking plates 188 are provided with wedging surfaces 194, 196, which, as is perhaps best seen in FIG. 11, cooperate with angled surfaces 198 and 200 on a piston member 202. The height of the piston member 202 corresponds to the height of the locking chamber 176, and its width corresponds to the width of the locking chamber. Thus, the piston member 202 is slidable within the locking chamber 176 toward and away from the hasp member 166.

Referring again to FIG. 11, in which the locking plates 188 are seen as they are assembled, movement of the piston member 202 to the left in the figure causes operative engagement between the wedging surfaces 194 and 196 of the locking plates 188 and the angled surfaces 198 and 200 of the piston member 202. A grove 204 in the rear wall of the locking chamber 176 provides a fulcrum for respective edges 206 of the locking plates 188, enabling the locking plates 188 to, in effect, pivot toward and away from each other. A biasing spring 206, interposed between the locking plates 188, causes the locking plates 188 to normally assume a position, as shown in FIG. 11, in which the respective wedging surfaces 194 and 196 move from each other and edges of the openings 190 and 192 bind against and lockingly engage the hasp member 166. When actuated as will now be described, the piston member 202, through the action of its angled surfaces 198 and 200, presses the portions of the locking plates 188 containing the wedging surfaces 194 and 196 toward each other.

It should be apparent from FIG. 11 that the bottom locking plate 188 will be caused to jam at an angle as the hasp member 166 moves downwardly relative to the locking chamber 176, and that the upper locking plate 188 will jam at an angle if the hasp member 166 moves upwardly. Thus, absent other action, which will now be described, the locking plates 188 effectively prevent motion of the hasp member 166 and thereby set the seat element 12 at a given location. Movement to the left in FIG. 11 of the piston member 202 causes compression of the spring 206 and rotation of the locking plates 188 in a manner such that the tendency of the locking plates 188 to jam is overridden, and the hasp member 166 is free to move through the locking chamber 176 without constraint. As is apparent in FIG. 11, the piston member 202 is itself biased, as by a spring 208, to a position in which the locking plates 188 are left free to assume their above-described function. Release of the piston member 202 allows the locking plates 188 to assume their locking positions relative to the hasp member 166.

Referring now to FIG. 10, there is seen within the housing 168 a mechanism for selectively moving the piston member 202 to release the locking plates 188, to facilitate adjustment of the seat angle. In this regard, pivotably mounted in the housing 168 is a shaft 210, coupled to a rotatable control rod 212 extending outwardly from the housing at 168. A suitable handle 214 (FIGS. 1 and 2) may be provided for the control rod, to facilitate rotation of the rod as indicated by the arrow in FIG. 10. A cam 216, secured to the shaft 210, serves to actuate a rocker arm 218, pivotably mounted in the housing 168. The rocker arm 218 includes a striker surface 220, justaposed to a tappet portion 222 of the piston member 202. It will now be seen that rotation of the shaft 210 and cam 216 causes rotation of the rocker arm 218 and projection of the striker surface 220 into surface contact with the tappet portion 222. Continued rotation of the shaft 210 causes movement of the piston member 202 against the bias of its spring 208, to bring together the locking plates 188 against the bias of the spring 206. In such a condition, the hasp member 166 may be freely moved through the various openings and bores, as well as through the openings 190 and 192 and the locking plates 188. Release of the handle allows the locking plates 188 to revert to their locking positions and to secure the hasp member 166 and hence the seat element 12 in their positions at the time of the release. The cam 216 and rocker arm 218 may be provided, if so desired, with a detent, such as the illustrated detent 224, to provide a positive detent/lock allowing for continuous free movement of the hasp 166 through the locking plates 188.

Although shown in association with the embodiment of FIG. 2, it should be understood that, if so desired, the mechanism shown in FIGS. 10 and 11 may be omitted, or, if desired, may be used with other embodiments of the apparatus, such as the one shown in FIG. 8.

Referring now to FIGS. 1 and 2, it will be seen that the center of gravity of the combined occupant and chair element is desirably in the vicinity of the column 20, well to the rear of the fulcrum point about which fore and aft or oblique movement occurs, at or very close to the transverse line between the points of attachment of the laterally extending support bar 30 and the seat element 12. Thus positioned, the fulcrum secures the desired ability of the seat support to smoothly and sometimes barely perceptively yield in fore and aft, lateral and oblique directions.

The present invention may be embodied in other specific forms without departing from its spirit or essential attributes, and accordingly, reference should be made to the appended claims rather than the foregoing specification as indicating the scope of the invention.

I claim:

1. A chair comprising a seat element having a seat base and a seat back, said seat base having a bottom wall; a support pedestal; a support arm between said pedestal and said seat element for supporting said char; and an ergonomic seat support operatively interconnecting said seat base and said support arm and providing for limited movement of said seat element under load relative to said support arm in fore and aft, lateral and oblique directions; said seat support comprising: a first support bar coupled to said support arm and extending longitudinally rearwardly with respect to said seat base, said first support bar being a cantilever spring member having a distal end portion thereof operatively engaging said bottom wall of said seat bottom to resiliently support said seat element at a rear location thereon, said seat element being capable of movement in a fore and aft direction against the resilience of said first support bar; a second support bar coupled to said support arm and extending transversely outwardly with respect to said support arm toward the sides of said seat base, respective end portions of said second support bar being secured to said bottom wall of said seat element at laterally spaced locations thereon remote from said support arm and said first support bar, said second support bar resiliently coupling said seat element to said support arm so that said seat element is capable of lateral movement relative to said support arm against the resilience of the coupling, whereby said first and said second support bars cooperate to provide for yielding of the seat element under load in fore and aft, lateral and oblique directions.

2. Apparatus in accordance with claim 1, wherein said second support bar is secured to said bottom wall at a forward location thereon, said cantilever spring member extending rearwardly and engaging said bottom wall at a rearward location on said seat base.

3. Apparatus in accordance with claim 2, and a latch coupled to said cantilever spring member for selective adjustment of the fore and aft tilt of said seat element.

4. Apparatus in accordance with claim 3, wherein said latch comprises a latch element secured to said cantilever spring member, a latch element engaging member operatively coupled to said pedestal and adapted to receive said latch element, and means operatively associated with said latch element engaging member to selectively cause said latch element engaging member to secure said latch element from movement relative to said latch element engaging member.

5. Apparatus in accordance with claim 4, wherein said first support bar is a cantilever spring member having a multiplicity of leaves, said latch element being pivotably secured to one of said leaves.

6. Apparatus in accordance with claim 2, and means coupled to said cantilever spring member to adjust the stiffness of said spring.

7. Apparatus in accordance with claim 6, and a latch coupled to said cantilever spring member for selective adjustment of the fore and aft tilt of said seat element.

8. A chair comprising a seat element having a seat base and a seat back, said seat base having a bottom wall; a support pedestal; a support arm between said pedestal and said seat element for supporting said chair; and an ergonomic seat support operatively interconnecting said base and said support arm, said seat support comprising: a first support bar coupled to said support arm and extending longitudinally with respect to said seat base, said first support bar being a cantilever spring member having a distal end portion thereof operatively engaging said bottom wall of said seat bottom to resiliently support said element; said cantilever spring member extending rearwardly and engaging said bottom wall at a rearward portion of said seat base; and a second support bar resiliently coupled to said support arm extending transversely with respect to said seat base, respective end portions of said support bar being secured to said bottom wall of said seat base to resiliently support said seat element, said respective end portions of said second support bar being secured to said bottom wall of said base at a forward portion of said seat base; and a bracket member coupled to and supported by said support arm, an elastomeric member operatively disposed between said second support bar and said bracket member, said second support bar having a center section and a pair of portions extending laterally outwardly from said center section in opposite directions, said elastomeric member receiving and encapsulating said center section.

9. Apparatus in accordance with claim 8, wherein said elastomeric member is disposed within said bracket member, and said first support bar having an end thereof disposed within and secured to said bracket member.

10. Apparatus in accordance with claim 9, wherein said bracket member is channel having an opening facing rearwardly with respect to said seat base, said first support arm having a distal end thereof projecting forwardly with respect to said seat base and extending into said opening; said elastomeric member being disposed within said opening, and said end of said first support bar disposed within said bracket being disposed between said distal end of said support arm and said elastomeric member.

11. Apparatus in accordance with claim 8, wherein said cantilever spring member comprises a leaf spring having a plurality of leaves.

12. Apparatus in accordance with claim 11, and means coupled to said cantilever spring member to adjust the stiffness of said spring.

13. Apparatus in accordance with claim 12, wherein at least one of said leaves of said leaf spring is selectively longitudinally shiftable with respect to the leaves adjacent thereto, and an actuator coupled to said shiftable leaf to facilitate shifting of said leaf.

14. Apparatus in accordance with claim 13, wherein said actuator comprises a threaded member rotatably coupled to said bracket member and said shiftable leaf.

15. Apparatus in accordance with claim 13, in which there are at least two shiftable leaves, said actuator being coupled to said shiftable leaves to simultaneously shift them.

16. Apparatus in accordance with claim 15, wherein said actuator comprises a threaded member rotatably coupled to said bracket member and to said shiftable leaves.

17. Apparatus in accordance with claim 8, wherein said cantilever spring member comprises a leaf spring having a plurality of leaves, at least one of said leaves contacting and resiliently supporting said seat base.

18. An ergonomic support for operatively interconnecting a seat element having a seat back and a seat base and a support arm adapted to support the seat element, comprising: a first support bar adapted to be coupled to the support arm; a second support bar having a center section and end portions extending laterally outwardly from said center section for securement to the seat base at laterally spaced locations thereon; said second support bar being operatively associated with said first support bar and extending generally perpendicularly with respect to said first support bar, said first support bar being a cantilever spring member having a distal end portion thereof adapted to engage and support the seat base at a rearward location thereof to resiliently support the rear of the seat element.

19. Apparatus in accordance with claim 18, wherein said second support bar is adapted to be secured to said bottom wall at a forward portion of said seat base, said cantilever spring member extending rearwardly with respect to said base, said distal end portion of said first support bar being slidably engageable with the bottom wall of said seat member.

20. Apparatus in accordance with claim 18, and a bracket member adapted to be coupled to said support arm, and an elastomeric member operatively disposed between said second support bar and said bracket member, said elastomeric member receiving and encapsulating said center section.

21. Apparatus in accordance with claim 20, wherein said elastomeric member is disposed within said bracket member, and said first support bar having an end thereof disposed within and secured to said bracket member.

22. An ergonomic support for operatively interconnecting a seat element having a seat back and a seat base and a support arm adapted to support the seat element, comprising: a first support bar adapted to be coupled to the support arm; a second support bar having a center section and end portions extending laterally outwardly from said center section for securement to the seat base at laterally spaced locations thereon, said second support bar being operatively associated with said first support bar and extending generally perpendicularly with respect to said first support bar, said first support bar being a cantilever spring member having a distal end portion thereof adapted to engage and support the seat base at a rearward location thereof to resiliently support the rear of the seat element, said second support bar being adapted to be secured to said bottom wall at a forward portion of said seat base, said cantilever spring member extending rearwardly with respect to said distal and end portion of being slidably engagable with the bottom wall of said seat member, said first and second support bars comprising respective leaf springs, each having a plurality of leaves, said support bars adapted to be coupled to said support arm by fasteners extending through said support bars and the support arm.

23. Apparatus in accordance with claim 22, wherein at least one of said leaves of said first support bar is selectively longitudinally shiftable with respect to the leaves adjacent thereto, and an actuator coupled to said shiftable leaf to facilitate shifting of said leaf, whereby the stiffness of said first support bar is selectively adjustable.

* * * * *

UNITED STATES PATENT AND TRADEMARK OFFICE

CERTIFICATE OF CORRECTION

PATENT NO. : 5,267,777

DATED : December 7, 1993

INVENTOR(S) : VALTRI

It is certified that error appears in the above-indentified patent and that said Letters Patent is hereby corrected as shown below:

Column 5, line 60, after "ends of", delete --15--.

Column 6, line 6, delete "Outwardly", and substitute therefor --outwardly--.

Column 8, line 51, delete "char", and substitute therefor --chair--.

Signed and Sealed this

Eleventh Day of October, 1994

*Attest:*

*Attesting Officer*

BRUCE LEHMAN

*Commissioner of Patents and Trademarks*